US009032549B1

(12) United States Patent
Cameron

(10) Patent No.: US 9,032,549 B1
(45) Date of Patent: May 19, 2015

(54) INFLATABLE BONNET CAP SYSTEM

(76) Inventor: Miltonia T. Cameron, Washington, NC (US)

( * ) Notice: Subject to any disclaimer, the term of this patent is extended or adjusted under 35 U.S.C. 154(b) by 577 days.

(21) Appl. No.: 13/363,747

(22) Filed: Feb. 1, 2012

(51) Int. Cl.
*A42B 1/12* (2006.01)
*A42B 3/12* (2006.01)

(52) U.S. Cl.
CPC ..... *A42B 3/122* (2013.01)

(58) Field of Classification Search
CPC ... A42B 1/12; A42B 1/041; B29L 2031/4828
USPC ..... 2/174, 171.3, 148, 413, 68
See application file for complete search history.

(56) References Cited

U.S. PATENT DOCUMENTS 1,501,409 A * 7/1924 Logan ..... 2/68
1,560,073 A * 11/1925 Bontempi et al. ..... 2/171.02
1,652,776 A * 12/1927 Galanis ..... 2/412
1,670,631 A * 5/1928 Miller, Jr. ..... 441/124
1,931,966 A * 10/1933 Rhodes ..... 2/68
2,072,483 A * 3/1937 Naundorf ..... 2/68
2,121,702 A * 6/1938 Larkin ..... 2/413
2,206,402 A * 7/1940 Howland ..... 2/68
2,285,659 A * 6/1942 Howland ..... 2/68
2,336,950 A * 12/1943 Moss ..... 2/68
2,354,916 A * 8/1944 Hurt ..... 264/552
2,664,567 A * 1/1954 Nichols ..... 2/413
3,092,112 A * 6/1963 Zelony ..... 607/114
3,186,004 A * 6/1965 Carlini ..... 2/413
3,370,304 A * 2/1968 Pelletier ..... 2/174
3,403,406 A * 10/1968 Weissberg ..... 2/68
3,556,115 A * 1/1971 Benson ..... 132/274
3,787,893 A * 1/1974 Larcher ..... 2/413
4,014,048 A * 3/1977 Rappleyea ..... 2/413
4,281,417 A * 8/1981 Valentine ..... 2/68
4,324,005 A * 4/1982 Willis ..... 2/413
D268,965 S * 5/1983 Lebowitz et al. ..... D2/868
4,441,214 A * 4/1984 Werner et al. ..... 2/174
4,683,596 A * 8/1987 Cole ..... 2/174
5,095,545 A * 3/1992 Lane ..... 2/68
5,133,084 A * 7/1992 Martin ..... 2/468
5,263,203 A * 11/1993 Kraemer et al. ..... 2/413
5,621,919 A 4/1997 Graham
6,481,020 B1 11/2002 Kirkland
6,622,310 B1 9/2003 Tsai

* cited by examiner

*Primary Examiner* — Richale Quinn

(57) ABSTRACT

An inflatable bonnet cap system for wrapping around a user's hair featuring an inflatable headpiece with a series of inflatable horizontal and vertical tubes, each horizontal tube has connectors and a valve for inflation, and a spring ring having a spring ring tube constructed with accordion-style seams, the spring ring tube has connectors with valves for inflation. An insert edge is on the bottom edge of the bottommost horizontal tube, and a wedge is disposed on the top surface of the spring ring tube. The insert edge can be accepted into the wedge of the spring ring tube. The system of is inflatable and retractable.

7 Claims, 7 Drawing Sheets

INFLATABLE BONNET CAP SYSTEM

FIELD OF THE INVENTION

The present invention is directed to a bonnet or shower cap, more particularly to a system with an inflatable headpiece that is wrapped around the user's hairline.

BACKGROUND OF THE INVENTION

Many individuals use rubber bands with shower caps and bonnets, or elastic bands line the bottom edges of shower caps and bonnets. However, rubber bands and elastic bands tend to leave marks on the user's heads (and can tear hair). Drawstring-type devices or scarves used in lieu of rubber hands often fail to stay in place. The present invention features an inflatable bonnet cap system. The system of the present invention utilizes an air pump for inflating the tubing, which tightens the tubing around the user's hairline. The user can roll up the system over his/her head.

SUMMARY

The present invention features an inflatable bonnet cap system. In some embodiments, the inflatable bonnet cap system comprises an inflatable headpiece comprising: a series of inflatable horizontal tubes arranged generally parallel to one another, a first horizontal tube and a second horizontal tube form outermost tubes of the inflatable headpiece, each horizontal tube has a first end and a second end; a first half connector disposed on the first end of each horizontal tube and second half connector disposed on the second end of each horizontal tube, the connectors can temporarily connect to each other to connect the ends of the horizontal tubes together; a one-way inflator valve disposed in each the first half connector and the second half connector; a series of inflatable vertical tubes arranged generally parallel to one another and perpendicularly to the horizontal tubes, the vertical tubes are each fluidly connected to the first horizontal tube, the second horizontal tube, and the horizontal tubes in between the first horizontal tube and the second horizontal tube; an insert edge disposed on a bottom edge of the second horizontal tube. The system further comprises a spring ring comprising: a spring ring tube having a first end, a second end, and a top surface, the spring ring tube is constructed with accordion-style seams allowing the spring ring tube to be adjustable in length; a first half connector disposed on the first end of the spring ring tube and a second half connector disposed on the second end of the spring ring tube, the connectors can temporarily connect to each other to connect the ends of the spring ring tube together; a one-way inflator valve disposed in each the first half connector and the second half connector; at least one wedge disposed in the top surface of the spring ring tube, the wedge is adapted to accept the insert edge of the inflatable headpiece to connect the inflatable headpiece to the spring ring.

In some embodiments, the first ends of each horizontal tube are aligned with each other and the second ends of each horizontal tube are aligned with each other. In some embodiments, the inflatable headpiece forms a dome. In some embodiments, the system comprises two wedges disposed in the top surface of the spring ring tube. In some embodiments, the system further comprises a shower cap, the shower cap has an insert edge adapted to be inserted into the wedge of the spring ring. In some embodiments, a slit is disposed in the shower cap, the slit can be sealed closed via a closing means. In some embodiments, the system further comprises an air pump, the air pump has a head portion and two ear portions branching off of the head portion, the ear portions engage the valves.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-10, the present invention features an inflatable bonnet cap system 100. The system 100 comprises an inflatable headpiece 105 and a spring ring 305. The inflatable headpiece 105 (or a shower cap 510) is attached to the spring ring 305.

Figure 1:
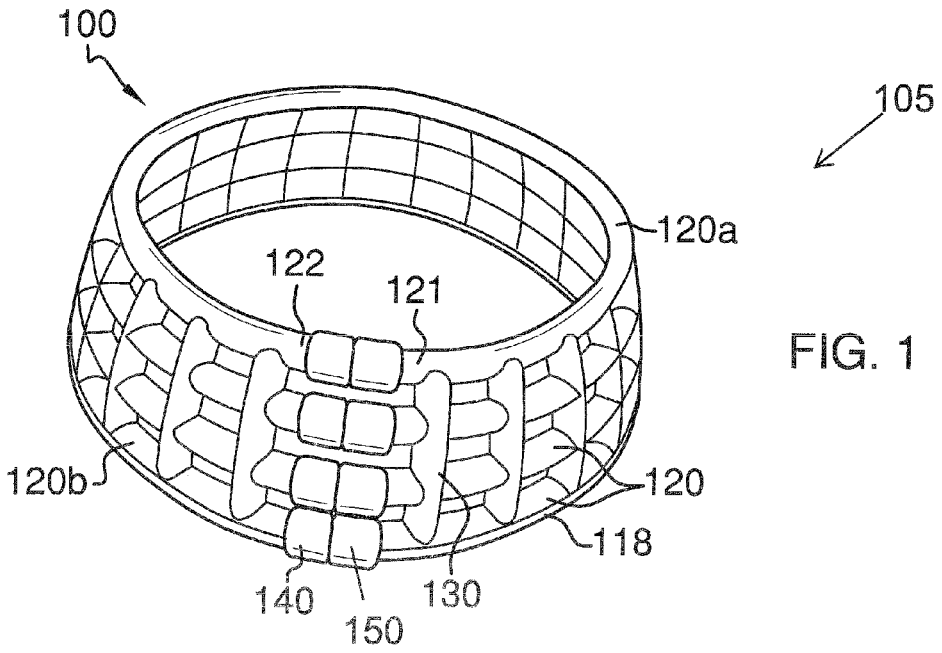
FIG. 1 is a perspective view of the inflatable headpiece of the system of the present invention.

As shown in FIG. 1, the inflatable headpiece 105 comprises a series of horizontal tubes 120 (e.g., two horizontal tubes, three horizontal tubes, four horizontal tubes, five horizontal tubes, etc.) arranged generally parallel to one another and form a band-like structure. The horizontal tubes 120 are inflatable. Each horizontal tube 120 has a first end 121 and a second end 122. The topmost horizontal tube is a first horizontal tube 120*a* (e.g., forming a top edge of the band-like structure) and the bottommost tube is a second horizontal tube 120*b* (e.g., forming a bottom edge of the band-like structure). In some embodiments, the first ends 121 of each horizontal tube 120 are aligned and the second ends 122 of each horizontal tube 120 are aligned (e.g., see FIG. 1).

A series of vertical tubes 130 are arranged generally parallel to one another and perpendicularly to the horizontal tubes 120. The vertical tubes 130 are inflatable. The vertical tubes 130 each extend from the first horizontal tube 120*a* to the second horizontal tube 120*b*. The vertical tubes 130 are each fluidly connected to the first horizontal tube 120*a* and the second horizontal tube 120*b*. The vertical tubes 130 are also each fluidly connected to each horizontal tube 120*a* in between the first horizontal tube 120*a* and the second horizontal tube 120*b*.

Disposed on the second horizontal tube 120*b* (e.g., the bottom edge of the second horizontal tube 120*b*) is an insert edge 118. The insert edge 118 is adapted to engage the wedge 318 of the spring ring tube 310 of the spring ring 305).

In some embodiments, the spaces between the tubes 120, 130 of the inflatable headpiece 105 are empty, e.g., the tubes 120, 130 create a mesh. In some embodiments, the spaces between the tubes 120, 130 of the inflatable headpiece 105 comprise a material.

Each horizontal tube 120 has a first end 121 and a second end 122. A first half connector 140 is disposed on the first end 121 of each horizontal tube 120 and a second half connector 150 is disposed on the second end 122 of each horizontal tube 120. The first half connector 140 and the second half connector 150 are adapted to be connected together (e.g., the second half connector 150 fits snugly in the first half connector 140). A slit or one-way inflator valve 155 is disposed in each the first half connector 140 and the second half connector 150. An air pump 710 engages each slit or one-way inflator valve 155 to inflate the tubes 120, 130.

Figure 2:
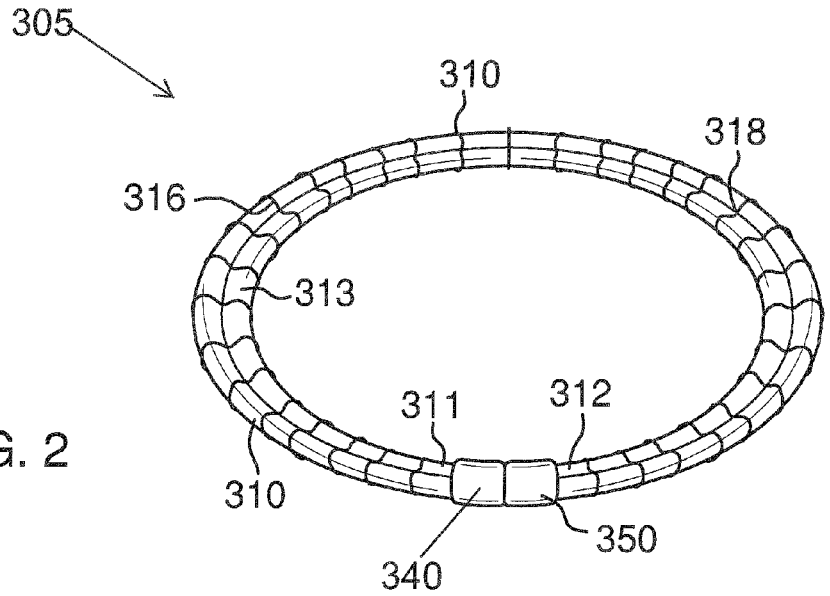
FIG. 2 is a perspective view of the spring ring of the system of the present invention (e.g., v-wedge)

As shown in FIG. 2, the system 100 comprises a spring ring 305. The spring ring 305 comprises a spring ring tube 310 (e.g., generally ring-shaped) having a first end 311, a second end 312, and a top surface 313. The spring ring tube 310 is adjustable in length. For example the spring ring tube 310 is constructed in an accordion style with accordion folds or seams 316 (e.g., similar to joints on straws, which are well known to one of ordinary skill in the art).

Figure 4:
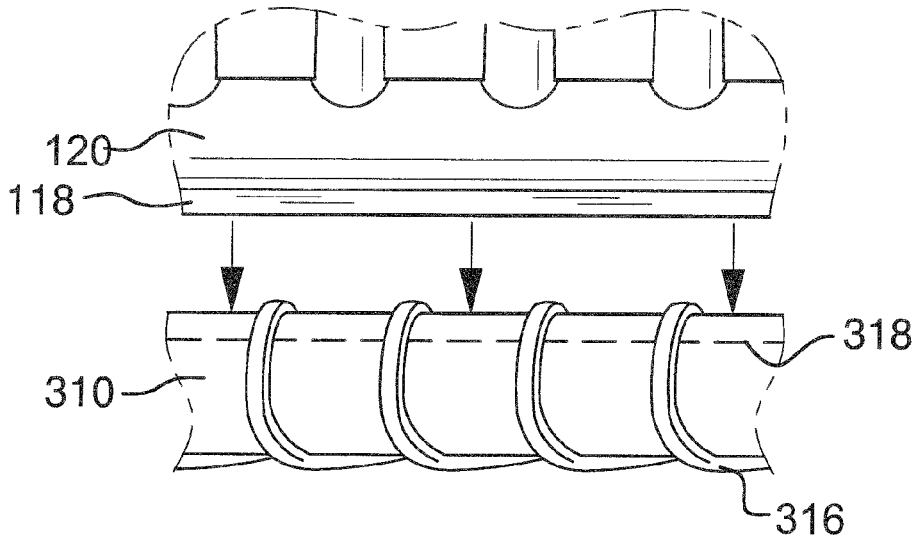
FIG. 4 is a side detailed view of the system of the present invention.
Figure 6:
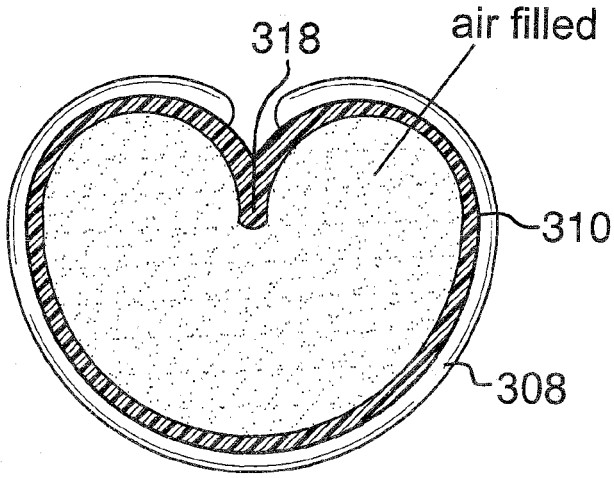
FIG. 6 is a cross sectional view of the system of FIG. 3.
Figure 9:
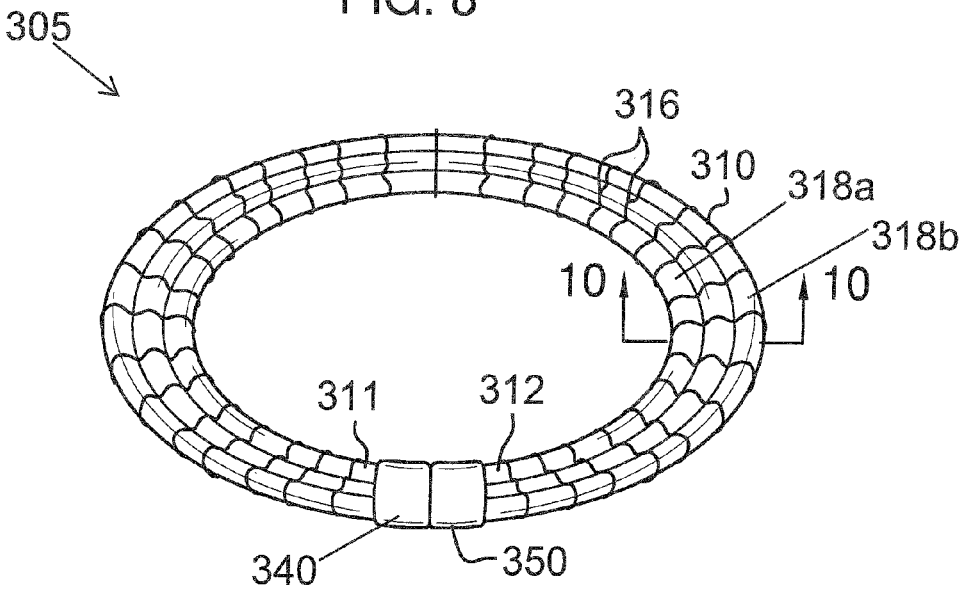
FIG. 9 is a perspective view of an alternative embodiment of the spring ring of the system of the present invention (e.g., a w-wedge).
Figure 10:
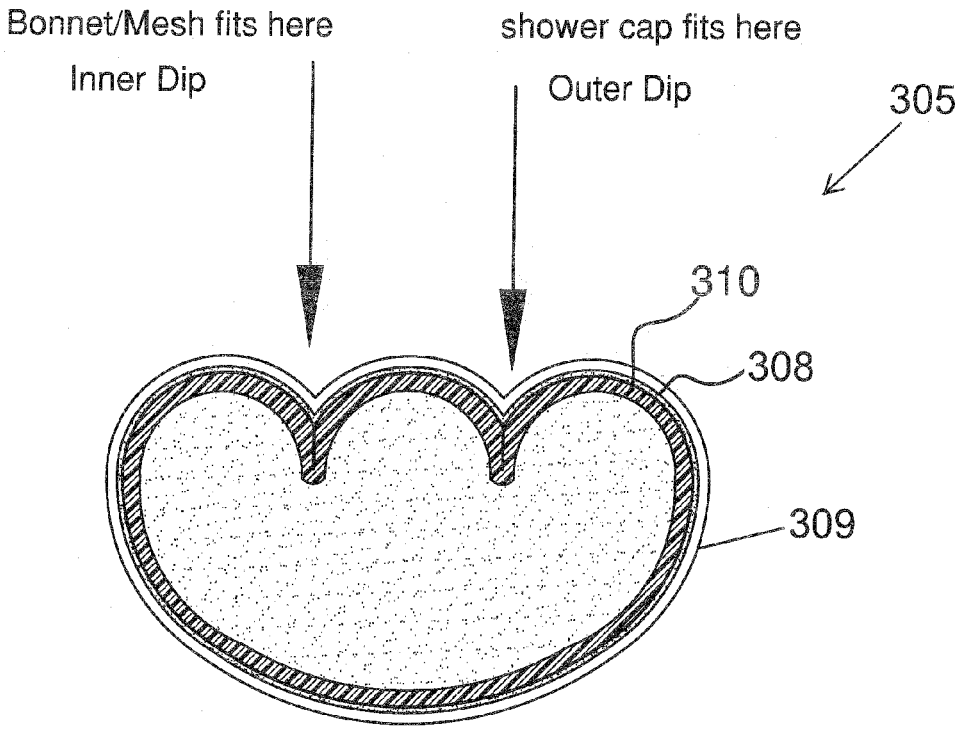
FIG. 10 is a cross sectional view of the system of FIG. 9 (w-wedge).

An indentation or wedge 318 (e.g., a V-wedge, a W-wedge) is disposed in the top surface 313 of the spring ring tube 310 of the spring ring 305. As shown in FIG. 4, the wedge 318 is adapted to accept the insert edge 118 of the inflatable headpiece 105. FIG. 6 shows a side cross sectional view of the spring ring tube 310, wherein the wedge 318 indents inwardly in the spring ring tube 310. The wedge 318 and insert edge 118 connection may resemble the connections used in seals of plastic bags (e.g., freezer bags, storage bags, etc.). FIG. 9 and FIG. 10 show an alternative embodiment wherein the wedge 318 is a W-wedge (with two indentations, e.g., a first indentation 318*a* and a second indentation 318*b*, e.g., one for the shower cap 510 and one for the inflatable headpiece 105 as shown in FIG. 10).

Figure 3:
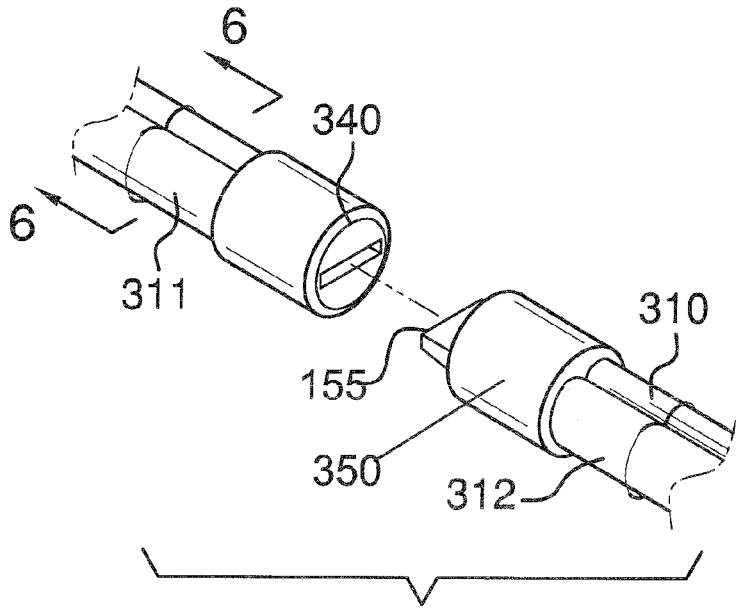
FIG. 3 is a detailed view of the system of the present invention.

As shown in FIG. 3, a first half connector 340 is disposed on the first end 311 of the spring ring tube 310 of the spring ring 305 and a second half connector 350 is disposed on the second end 312 of the spring ring tube 310 of the spring ring 305. The first half connector 340 and the second half connector 350 are adapted to be connected together (e.g., the second half connector 350 fits snugly in the first half connector 340). A slit or one-way inflator valve 155 is disposed in each the first half connector 340 and the second half connector 350. The air pump 710 engages each slit or one-way inflator valve 155 to inflate the spring ring tube 310.

Figure 7:
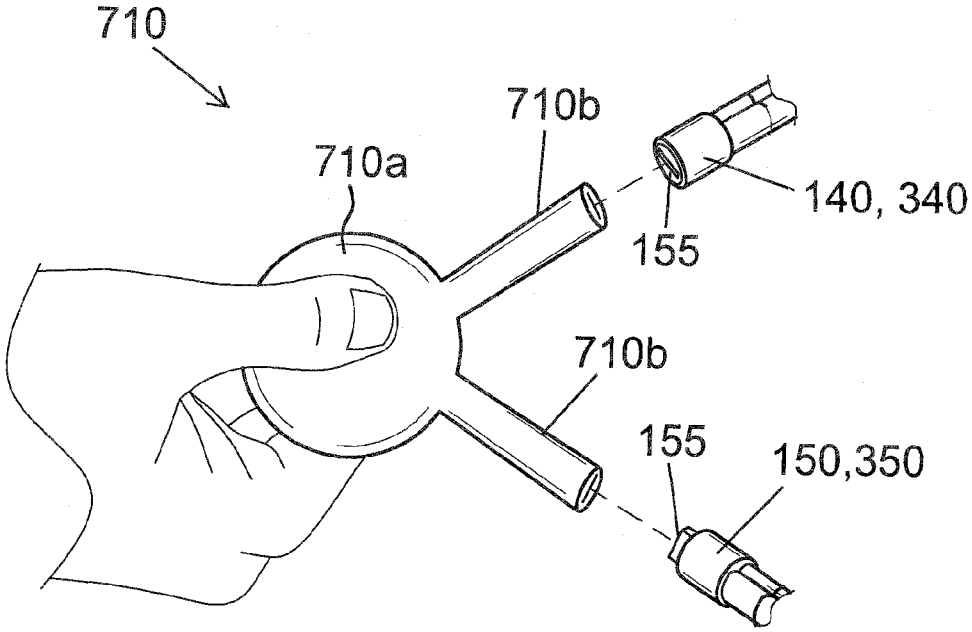
FIG. 7 is a perspective view of an air pump of the system of the present invention.

As shown in FIG. 7, the air pump 710 can be used to inflate the inflatable headpiece 105 and the spring ring 305. The air pump 710 has a head portion 710*a* and two ear portions 710*b* branching off of the head portion 710*a*. Air is pumped through the ear portions 710*b* by squeezing the head portion 170*a*. The ear portions are adapted to insert into the slits/valves 155 in the connectors 340, 350 of the spring ring tube 310 and the connectors 140, 150 of the horizontal tubes 120 of the inflatable headpiece 105. For example, one ear portion 710*b* fits into/onto the slit/inflator valve 155 in the connector 340 of the first end 311 of the spring ring tube 310 and the other ear portion 710*b* inserts into/onto the slit/inflator valve 150 in the connector 350 of the second end 312 of the spring ring tube 310. Air goes into the spring ring tube 310 via both ends 311, 312 and the spring ring tube 310 inflates.

Figure 5:
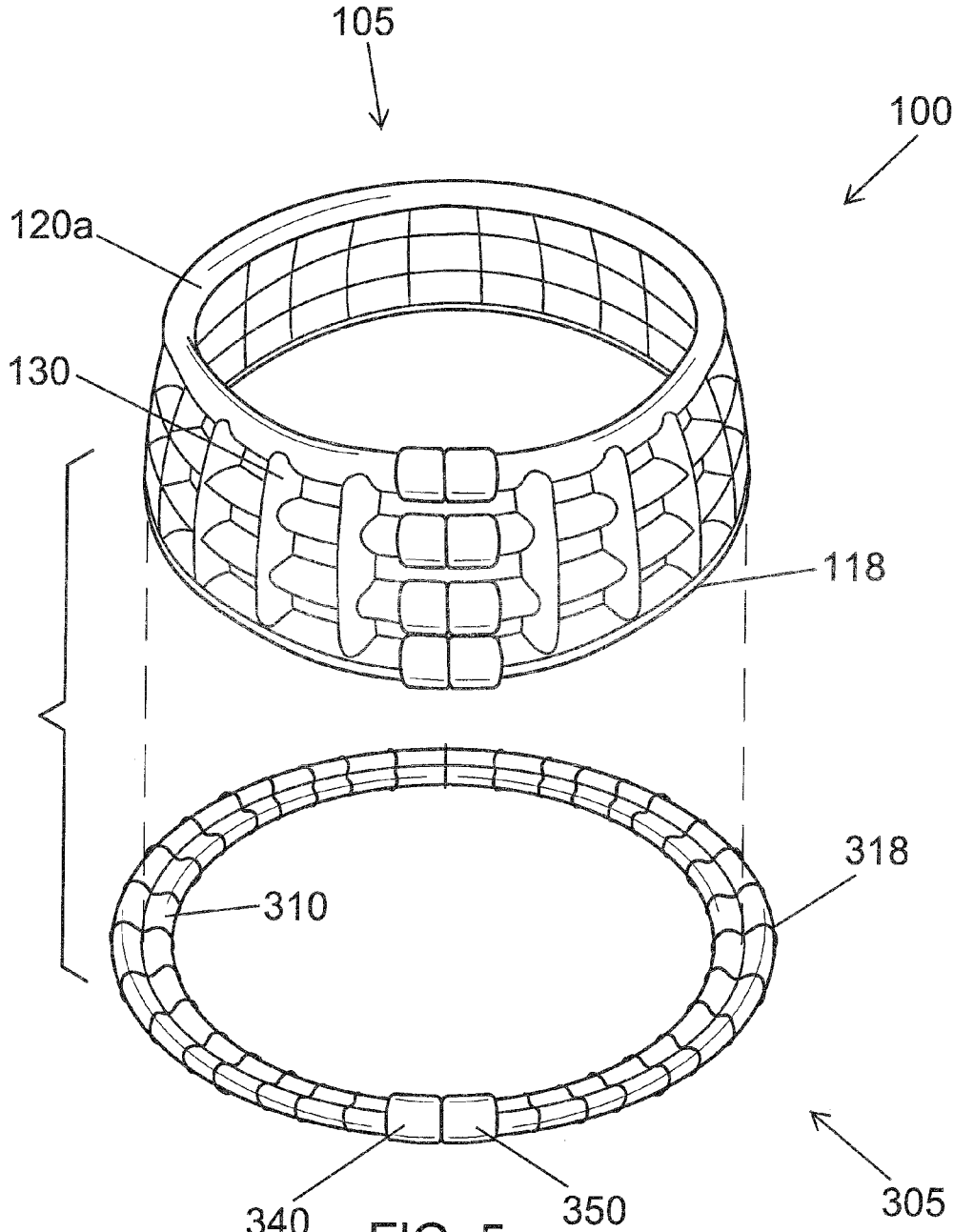
FIG. 5 is a perspective view of the system of the present invention.
Figure 5A:
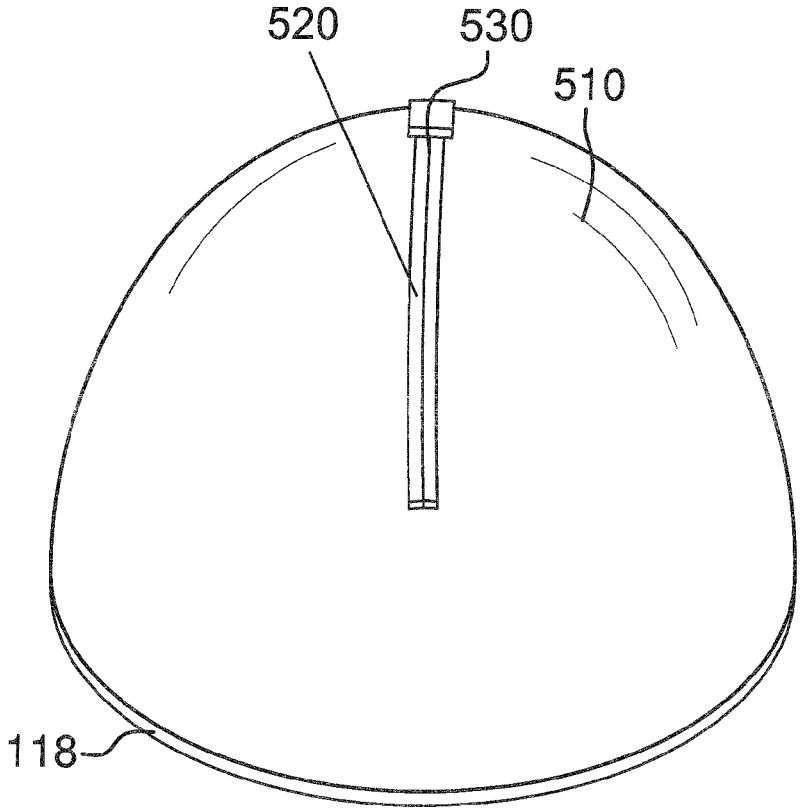
FIG. 5A is a perspective view of a shower cap of the system of the present invention.

As shown in FIG. 5A, the system 100 may comprise a shower cap 510 (or bonnet-like covering) for attaching to the spring ring 105 of FIG. 2 (or of FIG. 9). For example, the insert edge 118 of the shower cap 510 may be inserted into the wedge 318 of the spring ring tube 310 of the spring ring 305. The shower cap 510 is adapted to form a dome to cover the user's head. In some embodiments, the shower cap 510 comprises slit 530, e.g., at or near the top of the shower cap 510. In some embodiments, the slit 530 can be sealed in the closed position via a closing means. In some embodiments, the closing means includes but is not limited to a press and seal closure 520 (e.g., zipper closure).

As shown in FIG. 6, in some embodiments, an outer shell 308 surrounds all or a portion of the spring ring tube 310. In some embodiments, an outer shell 308 surrounds all or portions of other components of the system 100 (e.g., the inflatable headpiece 105, the spring ring 305, etc.). The outer shell 308, e.g., foam or other material, can help provide comfort. In some embodiments, an aesthetic layer 309, e.g., satin or other material, covers the shell 308/foam for aesthetic purposes.

Figure 8:
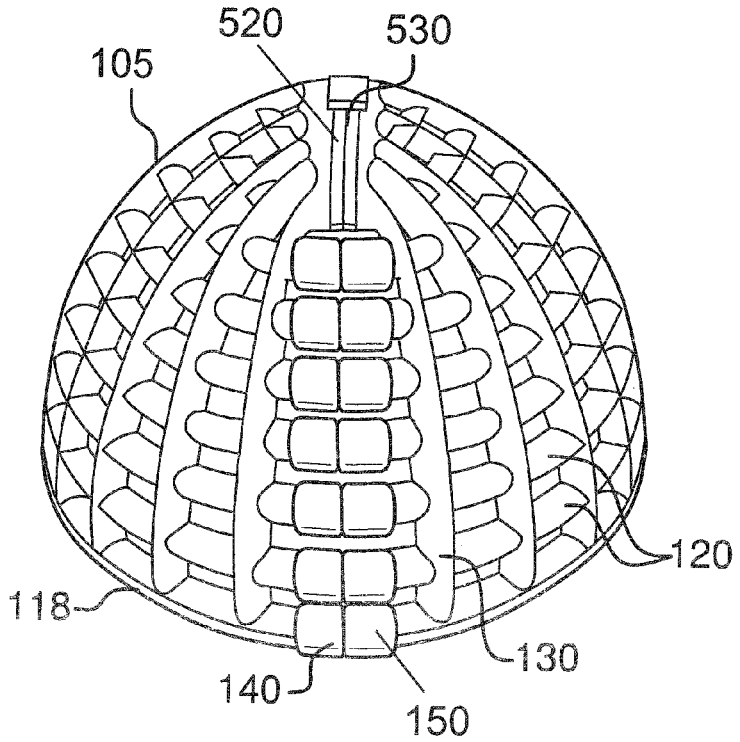
FIG. 8 is a perspective view of an alternative embodiment of the inflatable headpiece of the system of the present invention.

As shown in FIG. 8, in some embodiments, the inflatable headpiece 105 extends upwardly to form a dome (e.g., extends to the crown of the head and has longer vertical tubes 130 and more horizontal tubes 120. In some embodiments, the inflatable headpiece 105 comprises a slit 530, e.g., at or near the top of the inflatable headpiece 105. In some embodiments, the slit 530 can be sealed in the closed position via a closing means. In some embodiments, the closing means includes but is not limited to a press and seal closure 520 (e.g., zipper closure).

EXAMPLE 1

Use of the System

The following describes an example of the use of the system 100 of the present invention. The present invention is not limited to the below mentioned steps.

The user decides which headpiece (e.g., inflatable headpiece 105 of FIG. 1, inflatable headpiece 105 of FIG. 8, shower cap 510 of FIG. 5A) and which spring ring 305 (e.g., spring ring 305 of FIG. 2, e.g., spring ring 305 of FIG. 9) to use. The user connects the headpiece and the spring ring 305 together, e.g., as shown in FIG. 5. The user then places the system around her hairline and connects the ends of the spring ring 305 together via the connectors 340, 350. The user unrolls the headpiece (e.g., inflatable headpiece 105 of FIG. 1, inflatable headpiece 105 of FIG. 8, shower cap 510 of FIG. 5A) over her head and inserts the ears 710*b* of the air pump 710 into both slits 155 of the spring ring 305 to inflate the spring ring tube 310. The user inserts the ears 710*b* of the air pump 710 into both slits 155 of the headpiece (if applicable) to inflate the tubes 120, 130. The user pumps air until the desired pressure is reached to hold the hair in place. User can then disconnect the spring ring 305 and use the air pump 710 to inflate it to a desired pressure and reconnect the spring ring 305 (if necessary). The user can then connect the connectors 340, 350 of the headpiece (if necessary) seal the slit 530 of the headpiece (if necessary).

To take the system 100 off, the user disconnects the connectors 140, 150 of the headpiece and lets the headpiece retract (collapse), e.g., toward/into the spring ring 305. With the connectors exposed, air can escape the tubes as the headpiece retracts/collapses. The user can then disconnect the spring ring 305.

The headpieces (e.g., inflatable headpiece 105 of FIG. 1, inflatable headpiece 105 of FIG. 8, shower cap 510 of FIG. 5A) are retractable/collapsible. The user can decide which headpiece to place in the spring ring 305 and the user connects the spring ring 305 around her hairline. Then the user rolls up the headpiece to the top of her head, inflates and connects all the connectors and presses the seals.

The disclosures of the following U.S. Patents are incorporated in their entirety by reference herein: U.S. Pat. No. 3,370,304; U.S. Pat. No. 3,556,115; U.S. Pat. No. 4,014,048; U.S. Pat. No. 4,281,417; U.S. Design Pat. No. D268,965; U.S. Pat. No. 4,441,214; U.S. Pat. No. 4,683,596; U.S. Pat. No. 5,621,919; U.S. Pat. No. 6,481,020; U.S. Pat. No. 6,622,310.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An inflatable bonnet cap system (100) for wrapping around a user's hair, said system (100) comprising:

(a) an inflatable headpiece (105) comprising:

(i) a series of inflatable horizontal tubes (120) arranged generally parallel to one another, a first horizontal tube (120*a*) and a second horizontal tube (120*b*) form outermost tubes of the inflatable headpiece (105), each horizontal tube (120) has a first end (121) and a second end (122);

(ii) a first half connector (140) disposed on the first end (121) of each horizontal tube (120) and second half connector (150) disposed on the second end (122) of each horizontal tube (120), the connectors (140), (150) can temporarily connect to each other to connect the ends (121), (122) of the horizontal tubes (120) together;

(iii) a one-way inflator valve (155) disposed in each the first half connector (140) and the second half connector (150);

(iv) a series of inflatable vertical tubes (130) arranged generally parallel to one another and perpendicularly to the horizontal tubes (120), the vertical tubes (130) are each fluidly connected to the first horizontal tube (120*a*), the second horizontal tube (120*b*), and the horizontal tubes (120) in between the first horizontal tube (120*a*) and the second horizontal tube (120*b*);

(v) an insert edge (118) disposed on a bottom edge of the second horizontal tube (120*b*); and (b) a spring ring (305) comprising:

(i) a spring ring tube (310) having a first end (311), a second end (312), and a top surface (313), the spring ring tube (310) is constructed with accordion-style seams (316) allowing the spring ring tube (310) to be adjustable in length;

(ii) a first half connector (340) disposed on the first end (311) of the spring ring tube (310) and a second half connector (350) disposed on the second end (312) of the spring ring tube (310), the connectors (340), (350) can temporarily connect to each other to connect the ends (311), (312) of the spring ring tube (310) together;

(iii) a one-way inflator valve (155) disposed in each the first half connector (340) and the second half connector (350);

(iv) at least one wedge (318) disposed in the top surface (313) of the spring ring tube (310), the wedge (318) is adapted to accept the insert edge (118) of the inflatable headpiece (105) to connect the inflatable headpiece (105) to the spring ring (305).

2. The system (100) of claim 1, wherein the first ends (121) of each horizontal tube (120) are aligned with each other and the second ends (122) of each horizontal tube (120) are aligned with each other.

3. The system (100) of claim 1, wherein the inflatable headpiece (105) forms a dome.

4. The system (100) of claim 1 comprising two wedges (318) disposed in the top surface (313) of the spring ring tube (310).

5. The system (100) of claim 1 further comprising a shower cap (510) the shower cap has an insert edge (118) adapted to be inserted into the wedge (318) of the spring ring (305).

6. The system (100) of claim 5, wherein a slit (530) is disposed in the shower cap (510), the slit (530) can be sealed closed via a closing means (520).

7. The system (100) of claim 1 further comprising an air pump (710), the air pump (710) has a head portion (710*a*) and two ear portions (710*b*) branching off of the head portion (710*a*), the ear portions (710) engage the valves (155).

* * * * *